US006409963B1

(12) United States Patent
Gohres et al.

(10) Patent No.: US 6,409,963 B1
(45) Date of Patent: Jun. 25, 2002

(54) METALLURGIC CONTAINER

(75) Inventors: Hans-Werner Gohres, Duisburg; Franz-Josef Divjak, Rheinberg; Norbert Asmus, Moers, all of (DE)

(73) Assignee: Mannesmannröhen-Werke AG, Mülheim (DE)

( * ) Notice: Subject to any disclaimer, the term of this patent is extended or adjusted under 35 U.S.C. 154(b) by 0 days.

(21) Appl. No.: 09/763,296

(22) PCT Filed: Aug. 13, 1999

(86) PCT No.: PCT/DE99/02585

§ 371 (c)(1),
(2), (4) Date: Mar. 30, 2001

(87) PCT Pub. No.: WO00/10754

PCT Pub. Date: Mar. 2, 2000

(30) Foreign Application Priority Data

Aug. 12, 1998 (DE) ..... 199 38 202
Aug. 13, 1999 (DE) ..... 198 38 365

(51) Int. Cl.[7] ..... C21C 5/50
(52) U.S. Cl. ..... 266/246; 266/276; 266/275
(58) Field of Search ..... 266/246, 275, 266/276

(56) References Cited

U.S. PATENT DOCUMENTS 3,503,599 A * 3/1970 Jansa et al. ..... 266/246
6,036,916 A * 3/2000 Gohres et al. ..... 266/246
6,110,414 A * 8/2000 Gohres et al. ..... 266/246

* cited by examiner

*Primary Examiner*—Scott Kastler
(74) *Attorney, Agent, or Firm*—Cohen, Pontani, Lieberman & Pavane

(57) ABSTRACT

A metallurgic vessel, in particular a ladle for the transport of molten metals, with an upwardly open container which has a bottom receiving a refractory lining and a metal casing and is provided with a carrying framework which consists of carrying claws arranged on the outside of the metal casing and of at least one carrying ring running in the circumferential direction and two vessel carrying lugs which are located opposite one another and are supported on a plate connected to the carrying ring. In this case, the carrying framework has two carrying rings which are at a parallel distance from one another and, together with the plate and the vessel carrying lugs, form an independent unit which is at a distance from the outer surface of the metal casing and is arranged with play between the carrying claws.

7 Claims, 3 Drawing Sheets

METALLURGIC CONTAINER

BACKGROUND OF THE INVENTION

The invention relates to a metallurgic vessel, in particular a ladle for the transport of molten metals.

A metallurgic vessel is known from DE 195 38 530 C1. It consists of a metal casing which receives the refractory lining and is composed of individual tubular sections and which has two reinforcing rings running in the circumferential direction. The vessel further has two vessel carrying lugs which, located opposite one another on the outside of the metal casing, are supported in each case by a plate connected to the reinforcing rings. In this known design, the reinforcing rings are an integral part of the metal casing. It is also known to weld the reinforcing rings to the metal casing (DE-AS 29 01 011). The disadvantage of all the known designs is that they can be produced only at a high outlay in forming and welding terms and the differing rate of wear of the main components is not taken into account.

A somewhat differently designed metallurgic vessel is known from DE 29 05 283 B2. This is a tiltable and/or rotating steel mill converter. The converter is held by means of individual or interconnected carrying claws fastened to the vessel wall and prestressing units which are arranged parallel to and/or perpendicularly to the vessel longitudinal axis and make the connection between the carrying claws. A peripheral carrying ring is provided with a plate and vessel carrying lugs. The disadvantage of this design is the need to produce and arrange a plurality of prestressing units which considerably increase the construction costs.

Another converter design is disclosed in U.S. Pat. No. 3,503,559. In this design, two carrying rings are firmly connected to the metal casing at a parallel distance from one another. So that the converter can be exchanged in a simple way, the plates connected to the vessel carrying lugs are designed as individual elements which are connected releasably to one another by means of bolts with the aid of altogether four holding arms surrounding the metal casing. In order to guide the vessel under radial and axial expansion, the carrying rings have axially extending webs which engage into correspondingly designed recesses of the plates. The vessel is prevented from being displaced on one side by an axially extending web of the carrying ring, said web engaging into a corresponding recess in the holding arms.

SUMMARY OF THE INVENTION

The object of the invention is to provide a metallurgic vessel, in particular a ladle for the transport of molten metals, which can be produced more simply and the design of which takes into account the differing rates of wear.

According to the invention, the carrying framework has two carrying rings which are located at a parallel distance from one another and, together with the plate and the vessel carrying lugs, form an independent unit which is at a distance from the outside of the metal casing and is arranged with axial play between the carrying claws. This design is based on the idea that, particularly in the case of the ladle, the carrying framework has the function of transferring the most diverse transport situations into the ladle container without any reaction. The proposed arrangement has the advantage that the carrying framework and the container can be separated from one another at any time and the carrying framework can be used more frequently. It is known that the container has only a limited operating time of X melts, and must then be readjusted and, if necessary, repaired. In the designs known hitherto, the carrying framework cannot be used during readjustment and repair, since it is an integral part of the container. In the inventive design, then, it is advantageous that, at the end of a container trip, that is to say after the filling and emptying of, for example, 100 melts, the securing ring can be removed and the container can be pushed out of the carrying framework forming an independent unit. Subsequently, for example, it can be overturned, the refractory lining broken out and, if necessary, the metal casing and/or the bottom repaired. Readjustment is thereafter carried out again. During this entire time, the carrying framework used hitherto can be employed again for an already adjusted container. Another advantage of the invention is that the container can expand, unimpeded, in relation to the carrying framework both in the circumferential direction and in the axial direction. This leads to stress reductions, so that the design can be slimmer, that is to say with a smaller wall thickness. In other words, the proposed design makes it possible to produce a thin-walled, lightweight and nevertheless low-deformation container which, moreover, can be manufactured extremely cost-effectively and has considerable advantages in a repair situation.

For smaller vessels with an insignificant melt content and low requirements, it may even be cost-effective to design the container as a disposable article and continue to use the carrying framework as an independent unit. This concept would seem to be expedient for small electric steel mills. Such a simple container would be manufactured from a pipe section, a loose bottom would be inserted and the entire inner surface would be lined monolithically with a refractory compound.

Larger containers with melt contents of, for example, 250 t and above would be produced at a somewhat higher outlay and, if necessary, a frustoconical mount would be attached to the upper edge, so that the container, having a high free rim, is suitable for vacuum treatment and can easily be given a lid.

By an insulating layer being arranged in the contact region between the carrying framework and the claws or the securing ring, the heat flow between the hot container and the colder carrying framework can be reduced. Since there is no solid-state contact between the carrying framework and the container, apart from these contact bridges, the carrying framework can be designed more cost-effectively with regard to thermal stability.

For receiving the container in the carrying framework, it is necessary to have at least two claws located opposite one another and firmly attached to the metal casing. So that no tilting of the container can occur, preferably three or four claws will be provided. Alternatively, the claws may also be designed as a ring surrounding the metal casing. This ring may be welded onto the metal casing or be an integral part of the metal casing. In the latter case, this would lead to a desired reinforcement of the upper container edge.

BRIEF DESCRIPTION OF THE DRAWINGS

The metallurgic vessel designed according to the invention is explained in more detail, with reference to an exemplary embodiment, in the drawing in which.

DETAILED DESCRIPTION OF THE PREFERRED EMBODIMENTS

Figure 1:
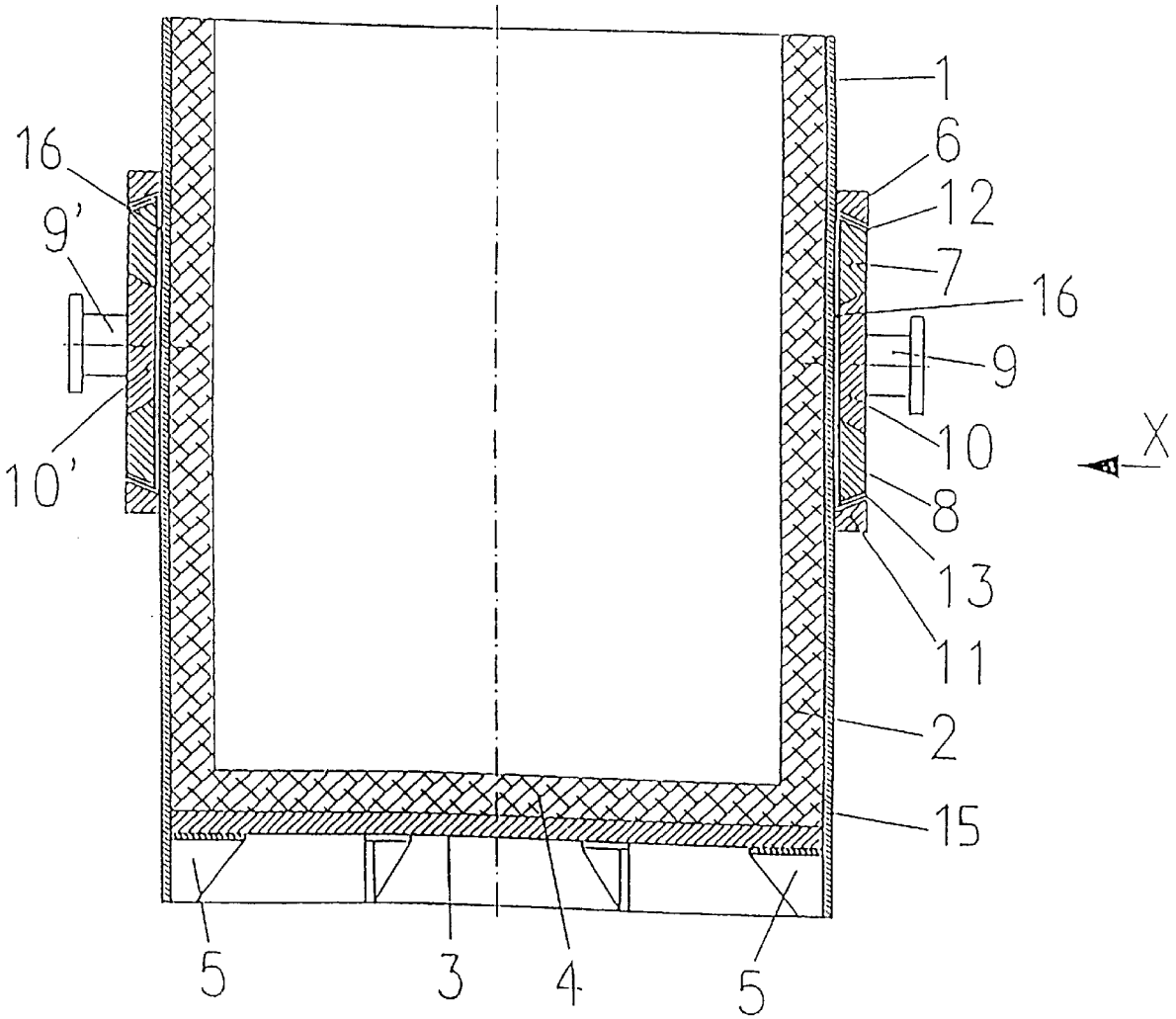
FIG. 1 shows a longitudinal section through a vessel designed according to the invention.
Figure 2:
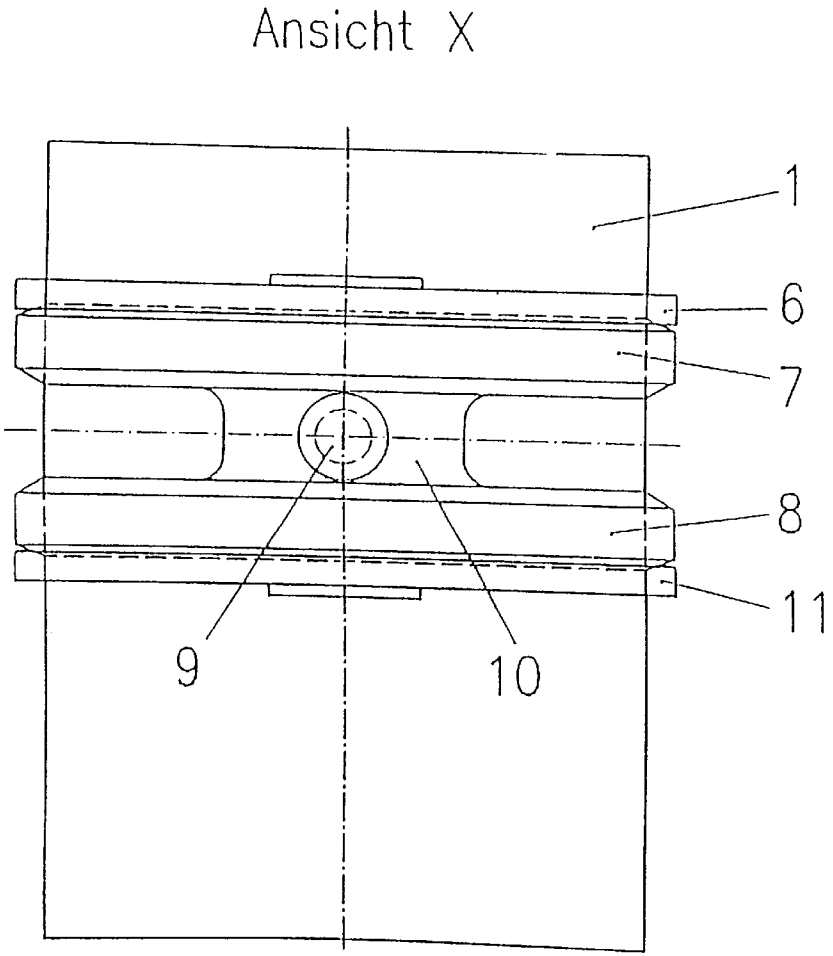
FIG. 2 shows a view in the direction X in FIG. 1.

FIG. 1 shows, in a longitudinal section, and FIG. 2, in a view, an exemplary embodiment of a metallurgic vessel designed according to the invention. This container consists of, for example, a single pipe section of a metal casing 1 which is composed of annular pipe sections and which is provided on the inside with a refractory lining 2. The bottom 3 is either merely inserted or fixed to the metal casing 1. The bottom 3 is also provided with a refractory lining 4. Feet 5 are arranged on the underside of the bottom 3, so that the container can be put down.

Figure 3:
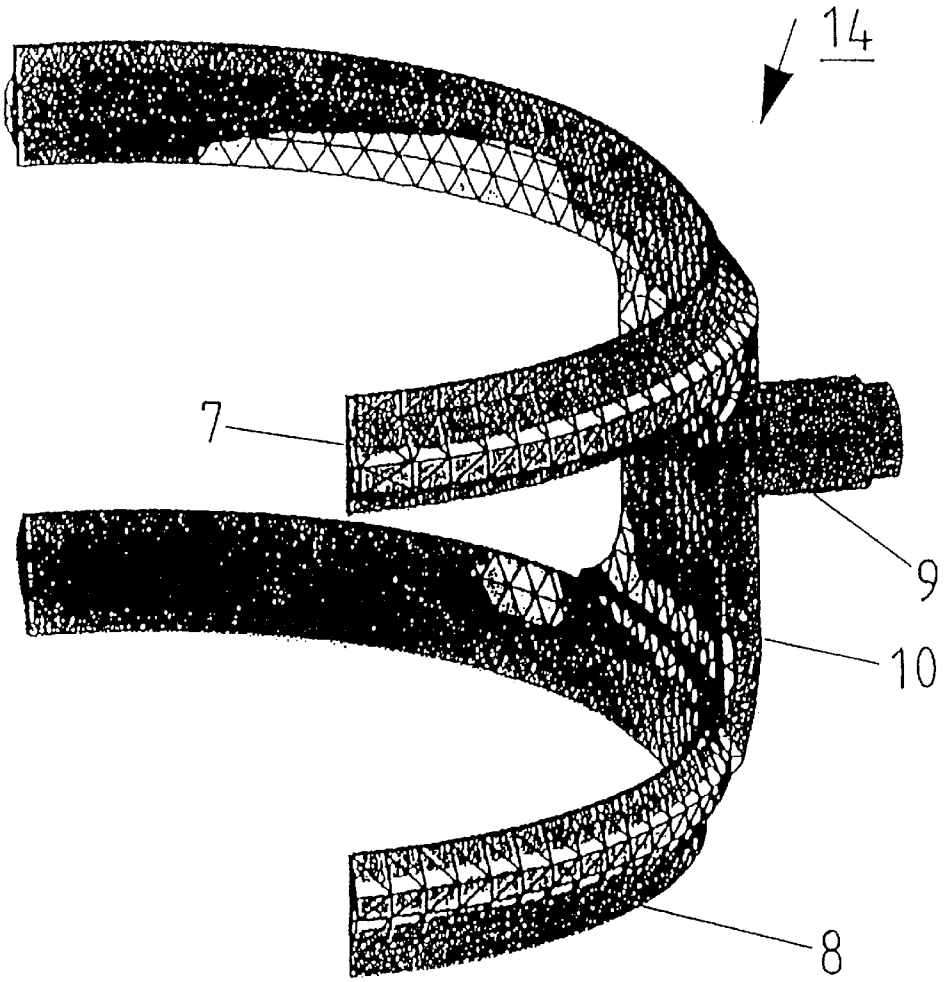
FIG. 3 shows a perspective illustration of a carrying framework forming an independent unit.

According to the invention, in the upper region of the metal casing 1, at least two claws 6, 6' located opposite one another are arranged fixedly. These form the abutment when the container is inserted into the carrying framework 14 (FIG. 3). The carrying framework 14 itself consists, in this embodiment, of two carrying rings 7, 8 and two vessel carrying lugs 9, 9' located opposite one another. These vessel carrying lugs 9, 9' are supported on a plate 10, 10' which is arranged between the two carrying rings 7, 8. The lower support for the carrying framework 14 is formed by a demountable and mountable securing ring 11 surrounding the metal casing 1. It is essential that the carrying framework 14, which forms an independent unit, is at a radial distance 16 from the outer surface 15 of the metal casing 1 and that the carrying framework 14 is arranged with axial play between the claws 6, 6' and the securing ring 11. In order to reduce the discharge of heat from the hot container to the carrying framework 14, an insulating layer 12, 13 is provided in each case between the claws 6, 6' and the securing ring 11.

Mounting takes place by the carrying framework 14 being placed on stands on a holding trestle and by a crane inserting the container into the carrying framework 14 from above. The securing ring 11 is subsequently attached, so that the carrying framework 14 can be supported on it. The suspension of hook slings, not illustrated here, takes place, so that the crossmember of the casting crane can lift the container above the top edge of the latter, transport it and tilt it through the hook slings. Demounting takes place in reverse order.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A metallurgic vessel, comprising: an upwardly open container which has a bottom and a metal casing; a refractory lining provided in the container; a unitary carrying framework including carrying means for carrying the container arranged on an outside of the metal casing, two carrying rings located at a parallel distance from one another and running in a circumferential direction and two vessel carrying lugs located opposite one another, plates being connected to the carrying rings and a respective one of the lugs being attached to each of the plates, the carrying rings together with the plates and the vessel carrying lugs form an independent unit which is at a distance from the outside of the metal casing and is arranged with play between the carrying means; at least two claws located opposite one another and fixed in an upper region of the metal casing for receiving the carrying framework; and a demountable and a mountable securing ring arranged to surround the metal casing for supporting an underside of the carrying framework so that the container is removable by demounting only the securing ring.

2. A metallurgic vessel as defined in claim 1, wherein the claws are formed as a ring surrounding the metal casing.

3. A metallurgic vessel as defined in claim 2, wherein the ring is an integral part of the metal casing.

4. A metallurgic vessel as defined in claim 1, wherein the metal casing is a pipe section, into which the bottom is separately insertable.

5. A metallurgic vessel as defined in claim 4, wherein the metal casing is a cone frustum with an upper larger covering surface.

6. A metallurgic vessel as defined in claim 1, wherein the metal casing is composed of individual tubular sections and is connected to the bottom which is shaped as a dished part.

7. A metallurgic vessel as defined in claim 1, and further comprising insulating means arranged between the carrying rings of the carrying framework and the claws, and between the carrying rings and the securing ring.

* * * * *

UNITED STATES PATENT AND TRADEMARK OFFICE

CERTIFICATE OF CORRECTION

PATENT NO. : 6,409,963 B1
DATED : June 25, 2002
INVENTOR(S) : Hans-Werner Gohres It is certified that error appears in the above-identified patent and that said Letters Patent is hereby corrected as shown below:

Title page,
Item [30], Foreign Application Priority Data, should read

-- Aug. 18, 1998 (DE) …….. 198 38 365.7

Aug. 12, 1999 (DE) …….. 199 38 202.6 --

Signed and Sealed this

Twenty-sixth Day of November, 2002

*Attest:*

*Attesting Officer*

JAMES E. ROGAN
*Director of the United States Patent and Trademark Office*